US008884727B2

(12) United States Patent
Kobayashi

(10) Patent No.: US 8,884,727 B2
(45) Date of Patent: Nov. 11, 2014

(54) ELECTROMAGNETIC RELAY

(71) Applicant: OMRON Corporation, Kyoto (JP)

(72) Inventor: Masaki Kobayashi, Iida (JP)

(73) Assignee: OMRON Corporation, Kyoto (JP)

( * ) Notice: Subject to any disclaimer, the term of this patent is extended or adjusted under 35 U.S.C. 154(b) by 71 days.

(21) Appl. No.: 13/723,162

(22) Filed: Dec. 20, 2012

(65) Prior Publication Data

US 2013/0241679 A1 Sep. 19, 2013

(30) Foreign Application Priority Data

Mar. 15, 2012 (JP) ..... 2012-059052

(51) Int. Cl.

| | |
|---|---|
| ***H01H 7/16*** | (2006.01) |
| ***H01H 75/00*** | (2006.01) |
| ***H01H 77/00*** | (2006.01) |
| ***H01H 51/20*** | (2006.01) |
| ***H01H 50/60*** | (2006.01) |
| ***H01H 45/12*** | (2006.01) |
| ***H01H 50/58*** | (2006.01) |

(52) U.S. Cl.

CPC ..... *H01H 45/12* (2013.01); *H01H 51/20* (2013.01); *H01H 50/60* (2013.01); *H01H 50/58* (2013.01)

USPC ..... 335/156; 335/128

(58) Field of Classification Search

CPC ..... H01H 45/12; H01H 51/20; H01H 50/60; H01H 50/58; H01H 2050/049; H01H 50/042; H01H 50/14; H01H 50/026

USPC ..... 335/78, 83, 128, 159–163, 202

See application file for complete search history.

(56) References Cited

U.S. PATENT DOCUMENTS

| | | | | |
|---|---|---|---|---|
| 4,816,794 | A | 3/1989 | Nagao | |
| 6,337,614 | B1 * | 1/2002 | Tsutsui | 335/160 |
| 6,903,638 | B2 * | 6/2005 | Nakamura et al. | 335/78 |
| 8,035,468 | B2 * | 10/2011 | Hoffmann et al. | 335/128 |
| 2004/0140873 | A1 * | 7/2004 | Funayama et al. | 335/128 |

FOREIGN PATENT DOCUMENTS

| | | |
|---|---|---|
| EP | 1050895 | 11/2000 |
| EP | 1284493 | 2/2003 |
| JP | 2000-315448 A | 11/2000 |

* cited by examiner

*Primary Examiner* — Bernard Rojas

(74) *Attorney, Agent, or Firm* — Blakely Sokoloff Taylor & Zafman

(57) ABSTRACT

Provided is an electromagnetic relay which can sufficiently dissipate heat generated from a coil to secure desired attracting force even when the electromagnetic relay is miniaturized. The electromagnetic relay includes an electromagnet block and a contact switching mechanism. A movable contact piece of the contact switching mechanism includes a contact attaching portion to which a movable contact is attached, and a first fixed portion attached to a first movable iron piece of the electromagnet block. The first fixed portion is in surface contact with the movable iron piece and is substantially equal in width dimension to the movable iron piece.

8 Claims, 9 Drawing Sheets

ELECTROMAGNETIC RELAY

TECHNICAL FIELD

The present invention relates to an electromagnetic relay.

RELATED ART

Conventionally, as an electromagnetic relay, there is known an electromagnetic relay having a configuration in which a fixed terminal is latched and attached to each spool of each electromagnet block in a press-fitted manner and each flange is connected in parallel to each other so that the electromagnet blocks may be integrally combined (see, for example, Japanese Unexamined Patent Publication No. 2000-315448).

However, in such a conventional electromagnetic relay, when the electromagnetic relay is miniaturized, a movable contact piece needs to be reduced in width dimension because of its structural characteristic. This also brings about the reduction in size of the electromagnet. Accordingly, in order to secure the same magnitude of attracting force with the electromagnet of the reduced size, it is necessary to increase the energizing amount flowing to a coil. For this reason, the calorific value from the coil increases. In this case, when the movable contact piece is decreased in the width and the surface area as described above, the heat generated from the coil may not be sufficiently discharged to the outside. As a result, it is difficult to secure the desired attracting force of the electromagnet, which makes it difficult to miniaturize the conventional electromagnetic relay.

SUMMARY

The present invention has been devised to solve the problems described above, and an object thereof is to provide an electromagnetic relay which can sufficiently dissipate the heat generated from a coil to secure desired attracting force even when the electromagnetic relay is miniaturized.

In accordance with one aspect of the invention, in order to achieve the above object, there is provided an electromagnetic relay including: a plurality of electromagnet blocks, each block including an electromagnet configured by winding a coil around an iron core via a spool, a yoke having a to-be-connected portion which is to be connected to a connection portion of one end of the iron core and a rising portion extending laterally from a magnetic pole portion of the iron core, a movable iron piece turnably supported by a distal end of the rising portion of the yoke and attracted to the magnetic pole portion of the iron core by magnetization of the electromagnet; and a contact switching mechanism including a movable contact piece attached to the movable iron piece and provided with a movable contact, and a fixed terminal attached to the spool to integrally combine the plurality of electromagnet blocks and provided with a fixed contact arranged to be brought into contact with and move away from the movable contact, wherein the movable contact piece includes a contact attaching portion to which the movable contact is attached and a first fixed portion that is attached to the movable iron piece, and the first fixed portion is brought into surface contact with the movable iron piece and is substantially equal in width dimension to the movable iron piece.

With this configuration, the surface area of the movable contact piece may be increased in the portion where the movable iron piece is in surface contact with the movable iron piece. Therefore, the heat generated due to the energizing of the coil may be sufficiently dissipated via a portion ranging from the movable iron piece to the first fixed portion of the movable contact piece.

In accordance with another aspect of the invention, in order to achieve the above object, there is provided an electromagnetic relay including: a plurality of electromagnet blocks, each block including an electromagnet configured by winding a coil around an iron core via a spool, a yoke having a to-be-connected portion which is to be connected to a connection portion of one end of the iron core and a rising portion extending laterally from a magnetic pole portion of the iron core, a movable iron piece turnably supported by a distal end of the rising portion of the yoke and attracted to the magnetic pole portion of the iron core by magnetization of the electromagnet; and a contact switching mechanism including a movable contact piece attached to the movable iron piece and provided with a movable contact, and a fixed terminal attached to the spool to integrally combine the plurality of electromagnet blocks and provided with a fixed contact arranged to be brought into contact with and move away from the movable contact, wherein the movable contact piece includes a contact attaching portion to which the movable contact is attached and a second fixed portion that is attached to the rising portion of the yoke, and the second fixed portion is brought into surface contact with the yoke and is substantially equal in width dimension to the yoke.

With this configuration, the surface area of the movable contact piece may be increased in the portion where the movable iron piece is in surface contact with the yoke. Therefore, the heat generated due to the energizing of the coil may be sufficiently dissipated via a portion ranging from the yoke to the second fixed portion of the movable contact piece.

Preferably, the respective spools are provided side by side at a position near the other end of the iron core where the magnetic pole portion is arranged, each of the flanges has a press-fitting recess at one side thereof in a direction of parallel arrangement, the fixed terminal has a plurality of press-fitted portions to be press-fitted into the press-fitting recesses of the respective spools, and the press-fitted portions are formed by cutting and raising portions of the fixed terminals in the direction of parallel arrangement.

With this configuration, the range, where the movable contact piece is arranged, in the flange may be provided so as to avoid only the press-fitting recess formed at one side in the direction of the parallel arrangement. Therefore, the range occupied by the movable contact piece may be increased. In addition, since the press-fitted portion formed in the fixed terminal is formed by cutting and raising, material punching can be performed without waste of material so that an increase in cost can be suppressed.

Preferably, the movable contact piece is made of an elastic material with a high thermal conductivity compared with the movable iron piece and the yoke.

With this configuration, the heat generated due to the energizing of the coil may be more efficiently dissipated via the movable contact piece.

According to the present invention, since the surface area of the movable contact piece where the movable contact piece is in surface contact with a component which constitutes the electromagnet block may be increased, the heat generated due to the energizing of the coil may be effectively dissipated. As a result, it becomes possible to prevent the deterioration of the operating characteristic attributable to the increase in temperature.

DESCRIPTION OF EMBODIMENTS

Figure 1:
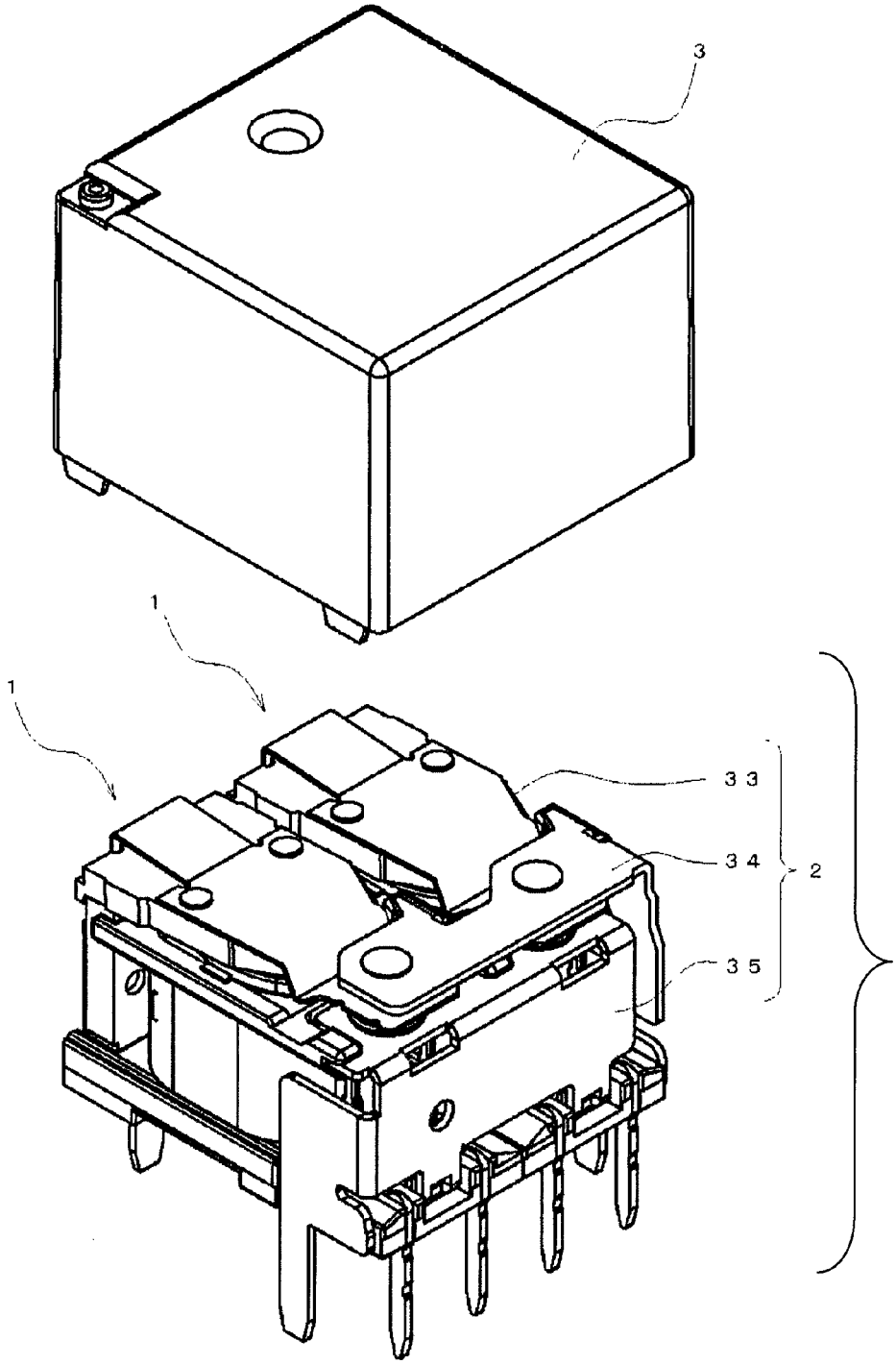
FIG. 1 is a perspective view illustrating a state in which a case of an electromagnetic relay according to an embodiment of the present invention is removed.

Hereinafter, preferred embodiments of the present invention will be described with reference to the drawings. Note that in the description below, terms that refer to specific directions and positions (for example, terms including "upper", "lower", "side", and "end") are used if necessary. The purpose of using those terms is to help one better understand the present invention referring to the drawings, but the technical scope of the present invention should not be limited by meanings of those terms. The description made hereinbelow represents just an essential example of the present invention and is not intended to limit the present invention, applications of the present invention, and uses of the present invention.

FIG. 1 illustrates an electromagnetic relay according to an embodiment of the present invention. This electromagnetic relay is configured such that one pair of electromagnet blocks 1 are provided side by side, a contact switching mechanism 2 is provided, and the electromagnet blocks 1 and the contact switching mechanism 2 are encased in a case 3.

Figure 2:
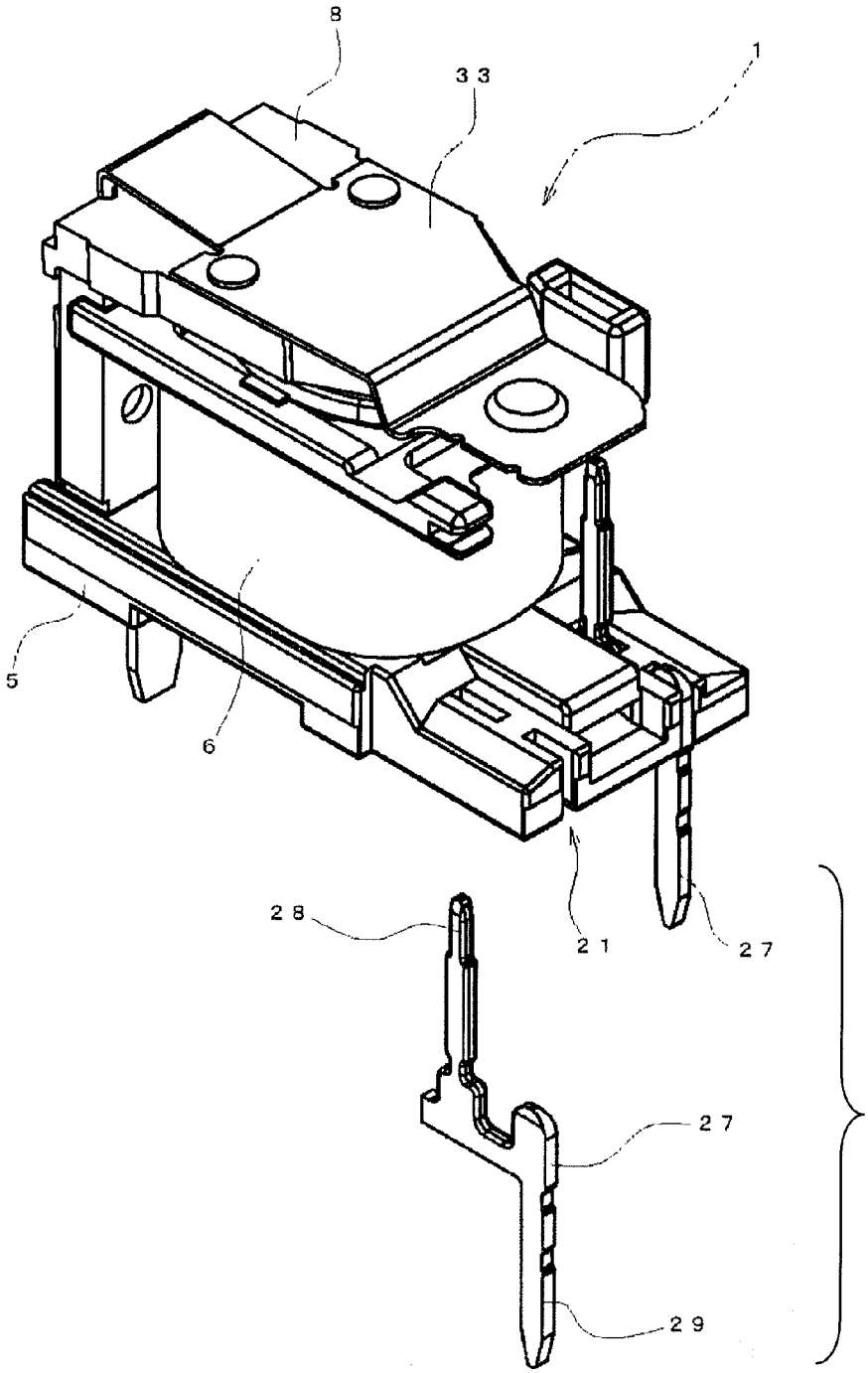
FIG. 2 is a perspective view of an electromagnet block of FIG. 1.
Figure 3:
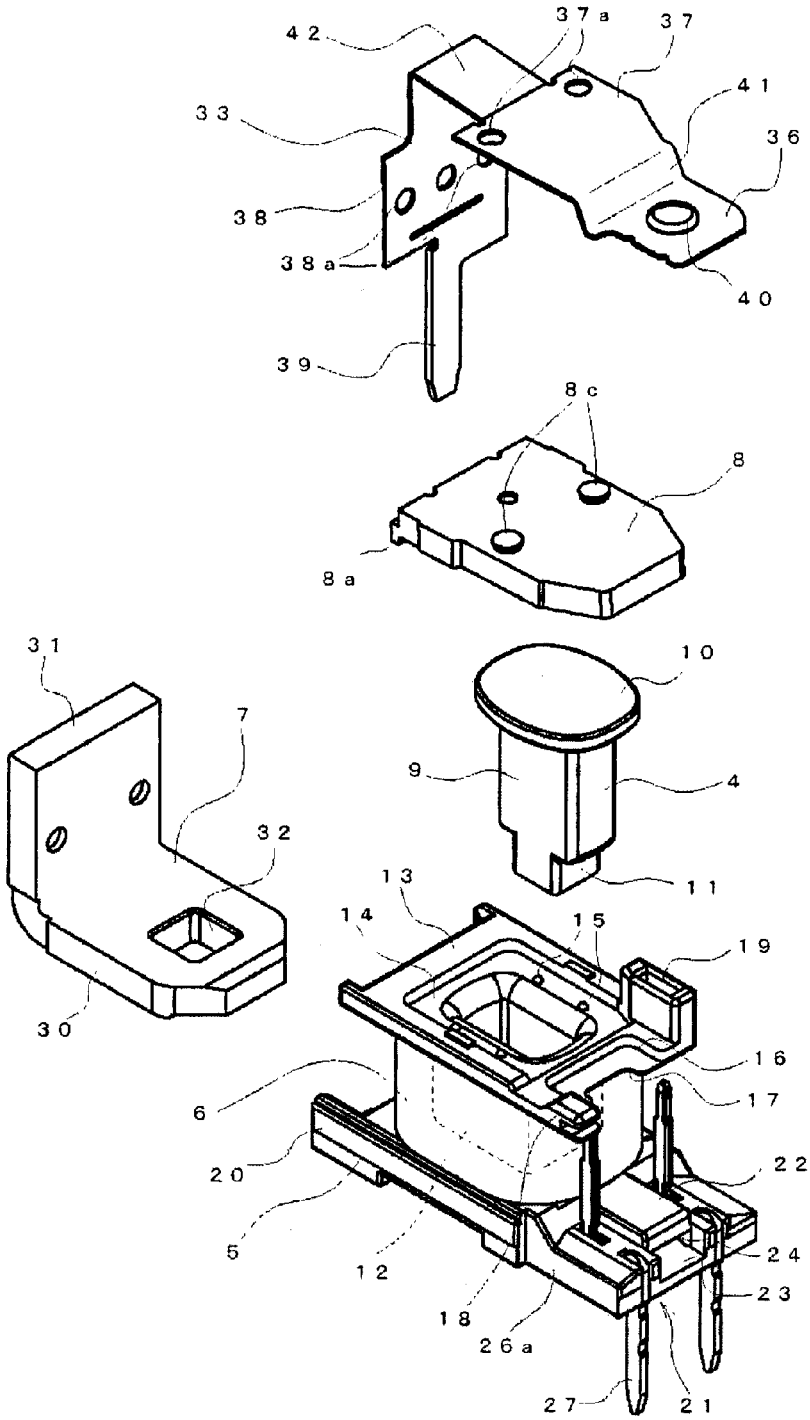
FIG. 3 is an exploded perspective view of the structure of FIG. 2.
Figure 4:
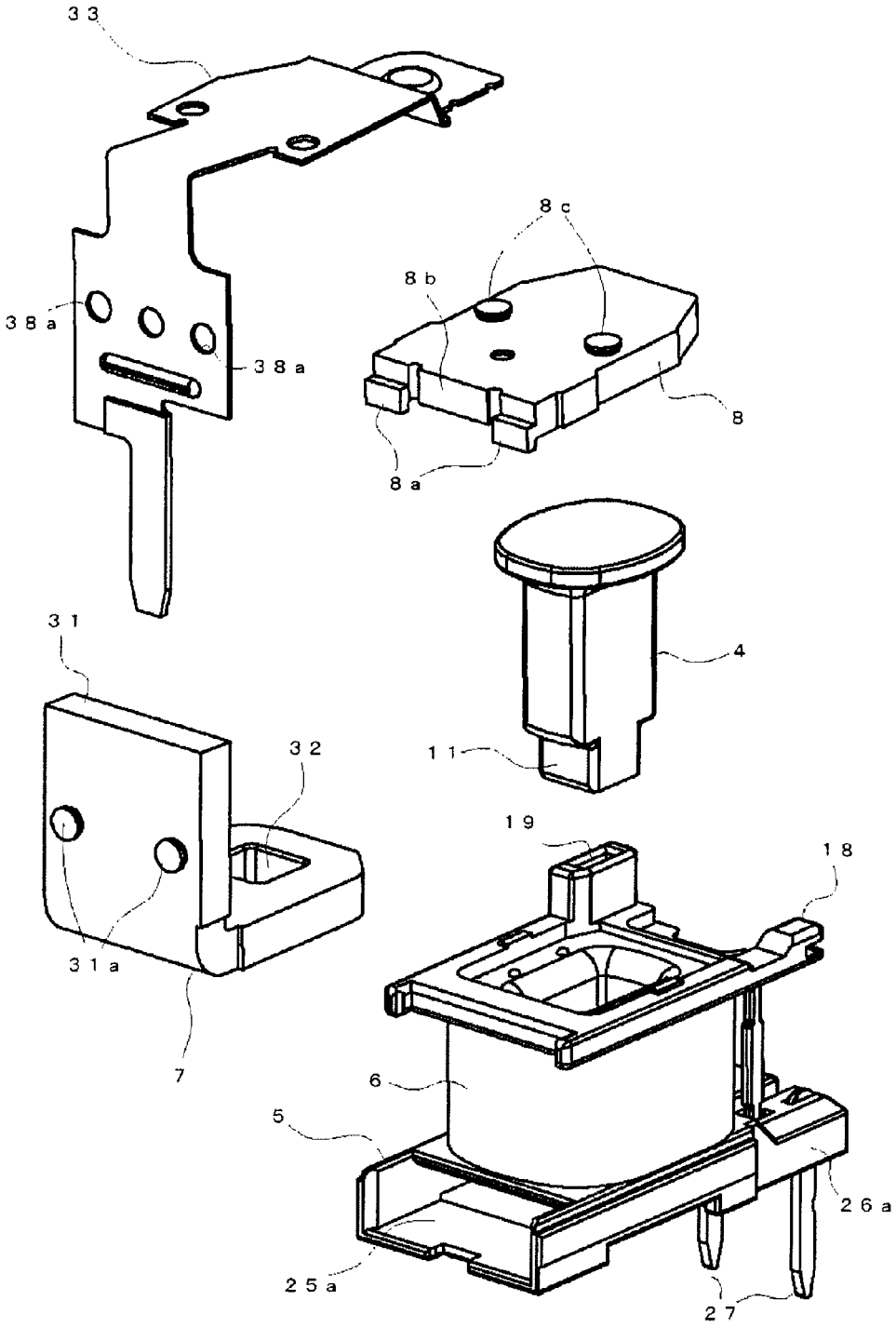
FIG. 4 is an exploded perspective view illustrating a state of the structure of FIG. 3 viewed from a different direction.

As illustrated in FIGS. 2, 3, and 4, each of the electromagnet blocks 1 is configured such that a coil 6 is wound around an iron core 4 via a spool 5, a yoke 7 is fixed to the iron core 4, and a movable iron piece 8 is turnably attached to the yoke 7.

The iron core 4 is formed in a bar shape made of a magnetic material and includes a trunk portion 9 having a rectangular cross-section, a flange-shaped magnetic pole portion 10 formed at an upper end portion of the trunk portion 9, and a connection portion 11 that is formed at a lower end of the trunk portion 9 and has a small cross-sectional area compared with the trunk portion 9. The magnetic pole portion 10 attracts the movable iron piece 8. The connection portion 11 is fitted into a connection hole 32 formed in the yoke 7 described below so as to be integrally combined.

The spool 5 is a component obtained by performing a molding process with a synthetic resin material and is configured such that flanges 13 and 20 which are substantially rectangular in a plan view are respectively provided at upper and lower end portions of a cylindrical portion 12. A central hole of the cylindrical portion 12 is formed to have an internal surface formed along the trunk portion 9 of the iron core 4.

A recess 14 in which the magnetic pole portion 10 of the iron core 4 is to be arranged is formed in the upper surface of the upper end-side flange 13 of the spool 5 so as to surround an opening of the central hole. There are four protrusions 15 on the bottom surface of the recess 14, especially around the opening of the central hole. The lower surface of the magnetic pole portion 10 is in contact with these protrusions 15 so that the position of the magnetic pole portion 10 in the vertical direction may be determined. Both ends of a first side of the upper end-side flange 13 (one side in the longitudinal direction) project outward, and the yoke 7 is arranged between the projected end portions. A step portion 16 is provided in the middle portion of a second side of the upper end-side flange 13 (the opposite side in the longitudinal direction), and a notch 17 is formed therein. A portion (contact stand) of a second fixed terminal 35 described below is located in the step portion 16, and a second fixed contact 53 described below is located in the notch 17. One flank portion of the second side of the upper end-side flange 13 is relatively thick, and a groove-shaped engagement socket 18 is formed in the middle portion in the vertical direction. A distal end portion of the first fixed terminal 34 is press-fitted into the engagement socket 18. The other flank portion of the second side of the upper end-side flange 13 projects upward, and a press-fitting recess 19 is formed in the upper surface thereof. The press-fitting recess 19 is substantially rectangular in a plan view, and a first press-fitted portion 47 of the first fixed terminal 34 is press-fitted into the press-fitting recess 19.

Figure 5:
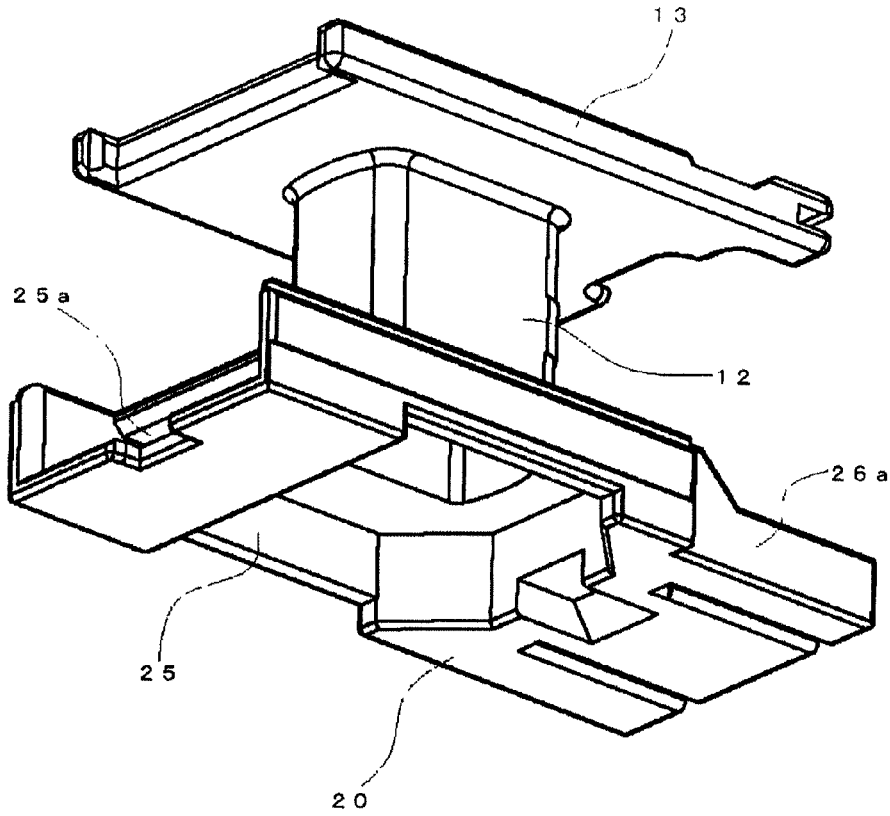
FIG. 5 is an exploded perspective view illustrating a state of a spool of FIG. 3 viewed from a difference direction.

The flange 20 provided at the lower end of the spool 5 protrudes from the upper end-side flange 13 toward the second side. Terminal attaching portions 21, each formed of a rectangular hole passing through the upper and lower surfaces and a notch, are formed at both sides of the projected portion, respectively. Formed between these terminal attaching portions 21 are an insulating wall portion 22 projecting upward and an engagement groove 23 which starts from one end of a lower end-side groove and extends toward the insulating wall portion 22. An engagement recess 24 is formed in the end face of the insulating wall portion 22 which is near the engagement groove. As illustrated in FIG. 5, a relief recess 25 in which a to-be-connected portion 30 of the yoke 7 is arranged is formed in the lower surface of the lower end-side flange 20. At the center of the relief recess 25, the central hole of the cylindrical portion 12 is open. The relief recess 25 communicates with one end face of the lower end-side flange 20 and a partial upper surface connected thereto via a communicating portion 25*a*, and the to-be-connected portion 30 of the yoke 7 can be inserted into the relief recess 25 from the side thereof. Recesses 26*a* and 26*b* in which terminal portions 49 and 57 of the respective fixed terminals 34 and 35 described below are to be arranged are formed in one side surface of the lower end-side flange 20. However, the recesses 26*a* and 26*b* are provided such that the side surfaces thereof are located between the pair of electromagnet blocks 1 so as to be opposite to each other.

The coil 6 is wound around the trunk portion 9 of the spool 5, and extension lines of the coil 6 are wound around and attached to a pair of coil terminals 27, which are respectively press-fitted and fixed to the lower end-side flange 20 of the spool 5. Each of the coil terminals 27 includes a winding portion 28 around which the extension line of the coil 6 is wound, and a terminal portion 29. A base portion of the winding portion 28 is press-fitted into and fixed by a rectangular hole of the terminal attaching portion 21 and an upper portion of the terminal portion 29 is press-fitted into and fixed by the notch.

The yoke 7 is obtained by bending a plate member of a magnetic material into an approximately L shape formed of the to-be-connected portion 30 and a rising portion 31. The to-be-connected portion 30 is provided with a connection hole 32 to which the connection portion 11 of the iron core 4 is connected. The rising portion 31 is provided with riveting projections 31*a* formed at a predetermined interval in a widthwise direction.

The movable iron piece 8 is a plate member of a magnetic material which is chamfered at corners of the distal end thereof so that the distal end of the movable iron piece 8 has a narrower width than the other portion. Supporting pieces 8*a* project from both ends of the rear end face of the movable iron piece 8, respectively, and a slot 8*b* extending from the upper surface to the lower surface is provided between the supporting pieces 8*a*. Riveting projections 8*c* are formed at a predetermined interval on the upper surface of the movable iron piece 8. The movable iron piece 8 is turnably supported by the upper end of the rising portion 31 of the yoke 7 so as to turn about the position (the upper end corner of the rising portion 31 of the yoke 7) where the lower surface of the movable iron piece 8 and the supporting piece 8*a* cross each other. In addition, a magnetic closed loop is formed by the iron core 4, the yoke 7, and the movable iron piece 8 so that the leakage of magnetic flux may be controlled.

As illustrated in FIG. 1, the contact switching mechanism 2 includes a movable contact piece 33 to be attached to the movable iron piece 8, and a first fixed terminal 34 and a second fixed terminal 35 to be attached to the spool 5.

As illustrated in FIGS. 3 and 4, the movable contact piece 33 has conductivity and elasticity, and is formed of a thin plate made of a material (for example, a copper-based alloy) with a heat transfer coefficient higher than that of the movable iron piece 8 and the yoke 7. The movable contact piece 33 includes a contact attaching portion 36, a horizontal fixed portion 37, a vertical fixed portion 38, and a movable terminal portion 39, which are arranged in this order from the distal end side. The contact attaching portion 36 is chamfered at one corner of the distal end thereof and has two arc-shaped notches at the side edge which is opposite to the side with the chamfered corner. The movable contact 40 is riveted and fixed to the contact attaching portion 36. The horizontal fixed portion 37 is connected to the contact attaching portion 36 via a first connection portion 41 which extends upward by the thickness of the movable iron piece 8 from the horizontal fixed portion 37, and extends over the upper surface of the movable iron piece 8. The horizontal fixed portion 37 has almost the same width dimension as the movable iron piece 8, and has a maximum surface area that can be designed. The horizontal fixed portion 37 is provided with two through-holes 37*a* at both sides thereof, and the projections 8*c* are inserted and riveted into the through-holes 37*a* so that the horizontal fixed portion 37 is fixed to the movable contact piece 8 (see FIG. 8). The horizontal fixed portion 37 and the vertical fixed portion 38 are connected to each other via a second connection portion 42 of a small width which is bent at about a right angle along the movable iron piece 8 and the yoke 7. The spring force exerted on the movable iron piece 8 is determined by the second connection portion 42. The vertical fixed portion 38 has a width dimension almost the same as the width dimension of the yoke 7, and has the maximum surface area that can be designed, similarly to the horizontal fixed portion 37. The vertical fixed portion 38 is provided with two through-holes 38*a* at both sides thereof, respectively, and projections 31*a* are inserted and riveted into the through-holes 38*a* so that the vertical fixed portion 38 is fixed to the yoke 7. Thus, the horizontal fixed portion 37 and the vertical fixed portion 38 have the maximum surface areas that can be designed (see FIG. 9). For this reason, the heat generated due to the energizing of the coil 6 can be effectively dissipated via the horizontal fixed portion 37 and the vertical fixed portion 38.

Figure 7:
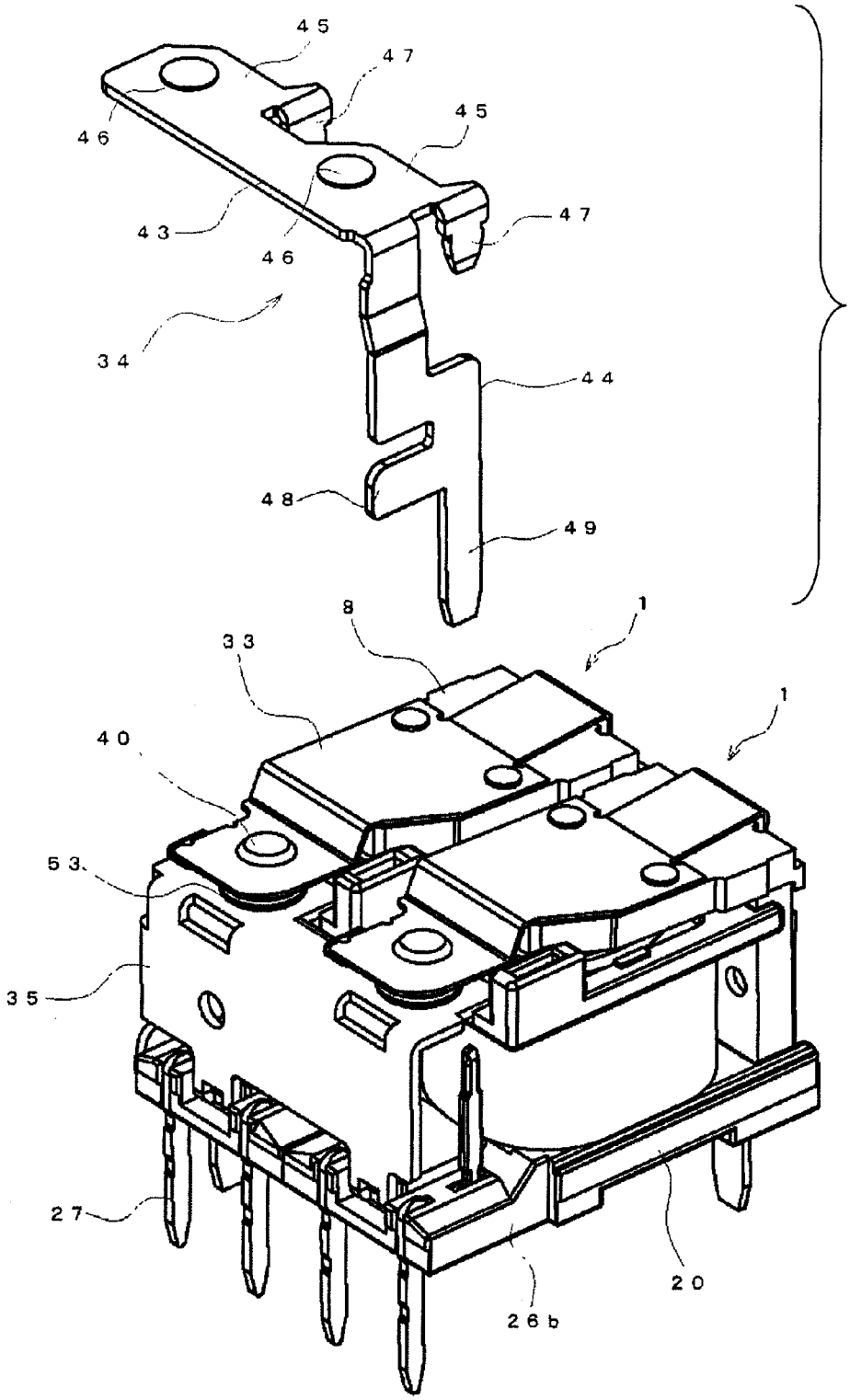
FIG. 7 is a perspective view illustrating a state changed from the state of FIG. 6 such that the second fixed terminal is assembled but a first fixed terminal is not yet assembled.

As illustrated in FIG. 7, the first fixed terminal 34 is obtained by bending a conductive plate member at about a right angle in almost the middle portion so as to form a first horizontal portion 43 and a first vertical portion 44. The first horizontal portion 43 is connected to a first contact stand 45 of the identical shape. Each of the contact stands is provided with a through-hole, and a first fixed contact 46 is riveted and fixed to the through-hole from the lower surface side. Each of the first contact stands 45 is chamfered at the corner of the distal end of one side edge, and a first press-fitted portion 47 bends and extends downward from a corner of the base portion. Each of the first press-fitted portions 47 is formed in a vertical portion which is perpendicular to the fixed contact, and has the width and thickness that gradually decrease toward the distal end. The first vertical portion 44 is bent such that it may be laterally displaced from a portion connected to the first horizontal portion 43, and the first vertical portion 44 includes an intermediate portion 48 arranged in the recess 26*b* of the spool 5, and a terminal portion 49 projecting from the lower surface of the spool 5.

Figure 6:
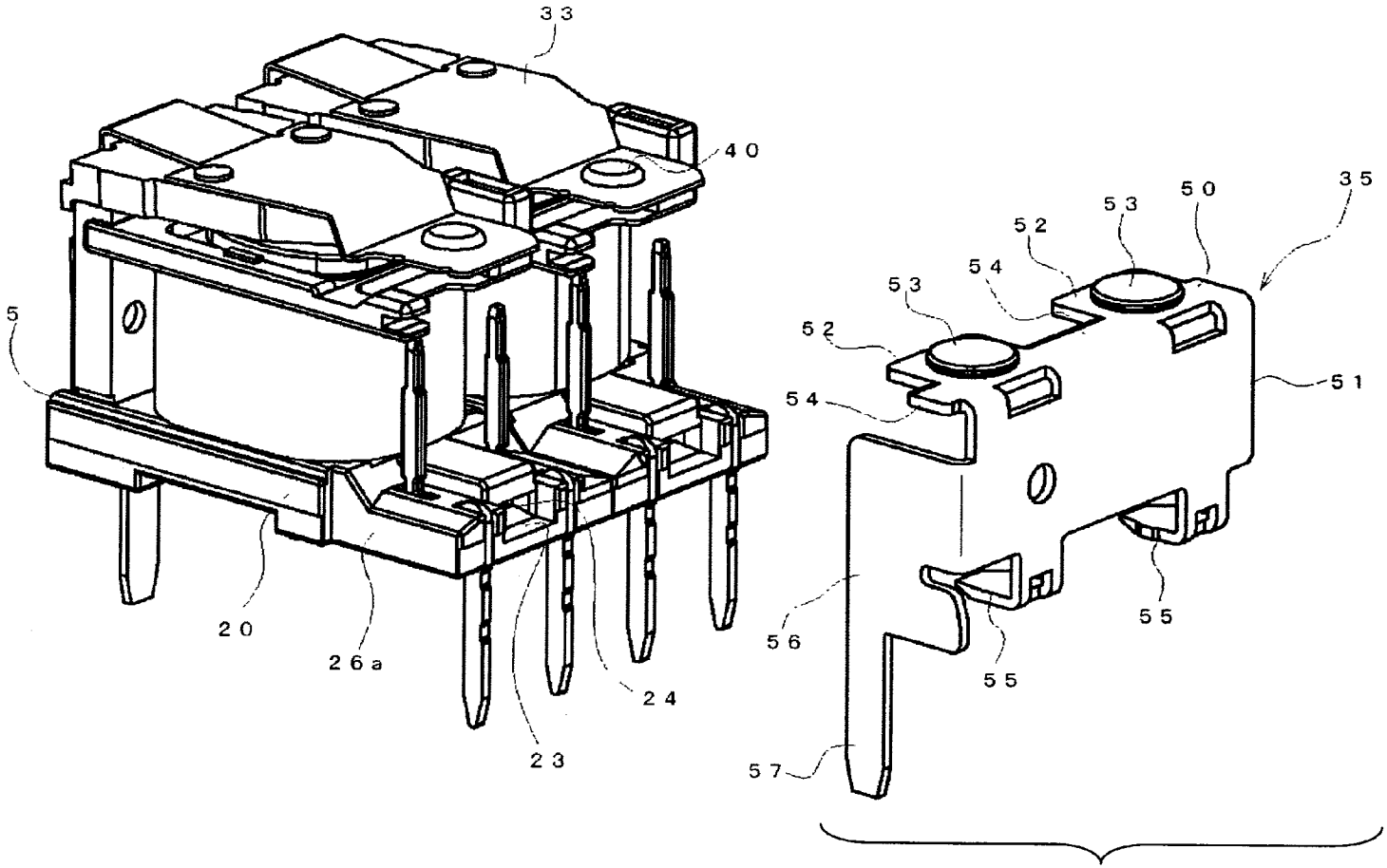
FIG. 6 is a perspective view illustrating a state in which the electromagnet blocks of FIG. 2 are arranged side by side and a second fixed terminal is not yet assembled.
Figure 8:
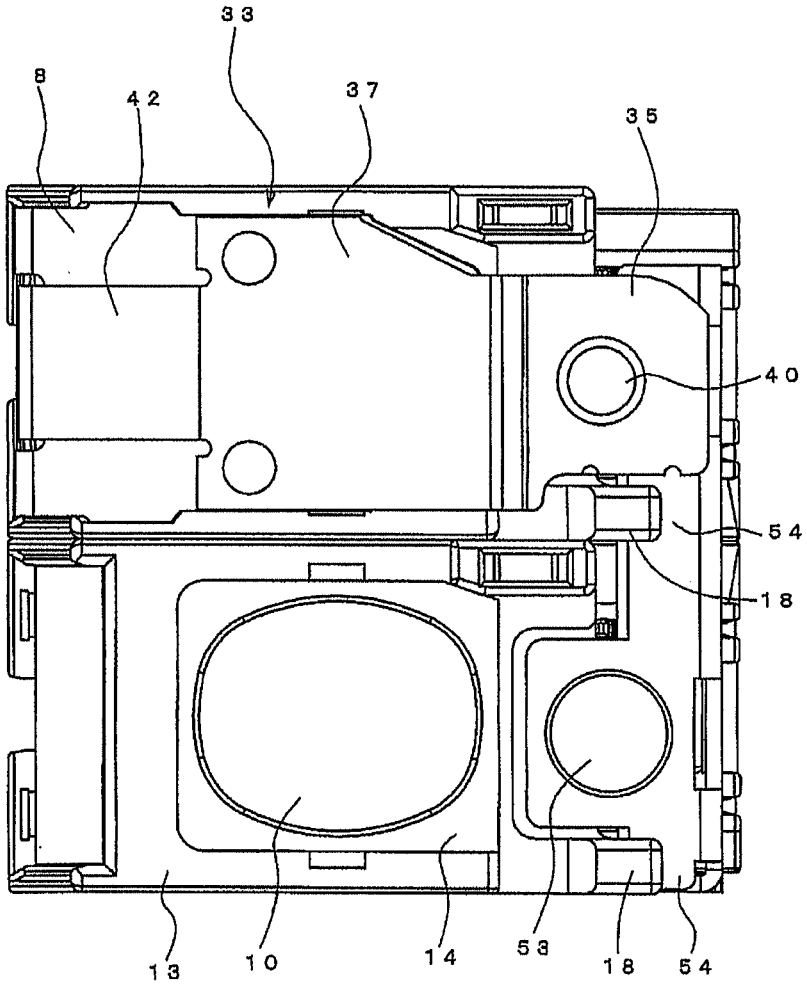
FIG. 8 is a plan view illustrating the state changed from the state of FIG. 7 such that a movable contact piece and a movable iron piece are removed and the first fixed terminal is not yet assembled.
Figure 9:
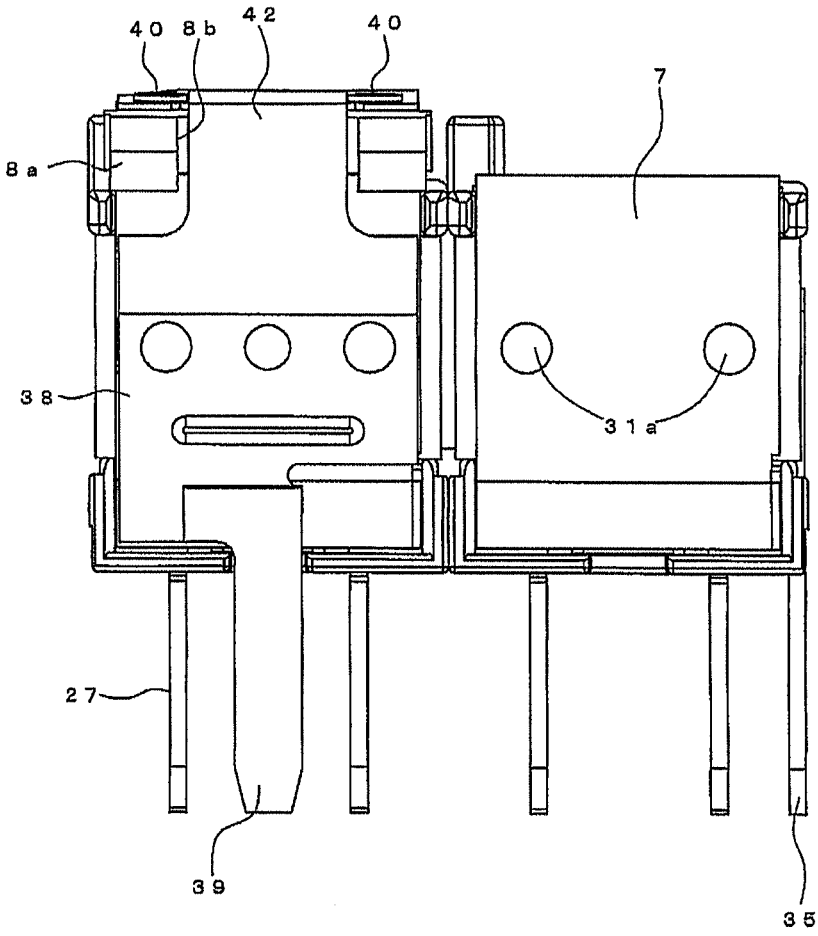
FIG. 9 is a front view of the structure of FIG. 8.

As illustrated in FIGS. 6 and 8, the second fixed terminal 35 is obtained by bending a conductive plate member at about a right angle in almost the middle portion so as to form a second horizontal portion 50 and a second vertical portion 51. Second contact stands 52 project from one side edge of the second horizontal portion 50 at a predetermined interval. Each of the second contact stands 52 is provided with a through-hole, and a second fixed contact 53 is riveted and fixed to the through-hole from the upper surface side. An upper-side second press-fitted portion 54 projects from one of the second contact stands 52. Among the portions which are connected to both the second contact stands 52, the side edge portion of the other one of the second contact stands also functions as an upper-side second press-fitted portion 54. Each of the upper-side second press-fitted portions 54 is press-fitted into the engagement socket 18 formed in the upper end-side flange 13 of the spool 5. Slit-shaped openings are formed in a connection portion (curved portion) between the second horizontal portion 50 and the second vertical portion 51, especially at the positions corresponding to the respective second contact stands 52. Lower-side second press-fitted portions 55 project downward from the lower edge of the second vertical portion 51, especially at the positions corresponding to the respective upper-side second press-fitted portions 54, and then bend to extend in the horizontal direction. The vertical portion of each of the lower-side second press-fitted portions 55 is provided with a rectangular opening which is formed to be near the horizontal portion. Each of the lower-side second press-fitted portions 55 is press-fitted into the engagement recess 24 via the engagement groove 23 formed in the lower end-side flange 20 of the spool 5. One end of the second vertical portion 51 includes an intermediate portion 56 which is bent at about a right angle and a terminal portion 57 extending downward therefrom.

Next, a method of assembling the magnetic relay will be described.

The coil 6 is wound around the spool 5, the pair of coil terminals 27 are press-fitted into and attached to the respective terminal attaching portions 21 of the lower end-side flange 20, and the extension lines of the coil 6 are wound and attached thereto, respectively. The to-be-connected portion 30 of the yoke 7 is inserted into the relief recess 25 in a lateral direction via the opening formed in the lower end-side flange 20 of the spool 5, and the rising portion 31 of the yoke 7 is positioned at the side of the wound coil 6. In addition, the iron core 4 is inserted into the central hole of the spool 5 from above, and the connection portion 11 at the distal end of the iron core 4 is fitted into the connection hole 32 of the yoke 7. The movable contact piece 33 is riveted and fixed to the movable iron piece 8, and the movable contact piece 33 is also riveted and fixed to the yoke 7 so that the electromagnet block 1 is completed. In this state, the movable iron piece 8 is kept away from the magnetic pole portion 10 of the iron core 4 due to the spring force of the movable contact piece 33.

Thus, two completed electromagnet blocks 1 are installed side by side, and both are integrally combined by the second fixed terminal 35. That is, the second fixed terminal 35 is assembled from the side of the pair of electromagnet blocks 1 arranged side by side. At this time, the upper-side second press-fitted portion 54 of the second fixed terminal 35 is press-fitted into the engagement socket 18 formed in the upper end-side flange 13 of the spool 5, and the lower-side second press-fitted portion 55 is press-fitted into the engagement recess 24 via the engagement groove 23 formed in the lower end-side flange 20. In this state, the intermediate portion 56 of the second fixed terminal 35 is positioned in the recess 26*a* formed in the lower end-side flange 20 of one of the electromagnet blocks 1, and the intermediate portion 56 is not projected from the side of the spool 5.

Moreover, the connection of the electromagnet blocks 1 becomes stronger by the first fixed terminal 34. That is, the first fixed terminal 34 is assembled to the electromagnet blocks 1 integrally combined, from above. At this time, the first press-fitted portion 47 is press-fitted into the press-fitting recess 19 formed in the upper end-side flange 13 of the spool 5. In this state, the intermediate portion 48 of the first fixed terminal 34 is positioned in the recess 26*b* formed in the lower end-side flange 20 of the other one of the electromagnet blocks 1, and the intermediate portion 48 is not projected from the side of the spool 5.

In this way, since the pair of electromagnet blocks 1 is integrally combined not only by the second fixed terminal 35 assembled from the side but also by the first fixed terminal 34 assembled from above, the combined state is stable. Thereafter, the case 3 is put on the combined electromagnet blocks 1, and as a result, the electromagnetic relay is completed.

Next, the operation of the magnetic relay will be described. Under a condition in which the coil 6 is not energized and the electromagnet blocks 1 are not yet magnetized, the movable iron piece 8 is turned about the upper end corner of the yoke 7 due to the spring force of the movable contact piece 33 such that the movable iron piece 8 moves away from the magnetic pole portion 10 of the iron core 4. Next, the movable contact 40 is brought into contact with the first fixed contact 46.

Here, when the coil 6 is energized and the electromagnet block 1 is magnetized, the movable iron piece 8 is attracted to the magnetic pole portion 10 of the iron core 4 and is turned against the spring force of the movable contact piece 33. Therefore, the movable contact 40 moves away from the first fixed contact 46, and comes into contact with the second fixed contact 53.

Incidentally, when the coil 6 is energized and thus the electromagnet blocks 1 are magnetized, there is a concern that heat is generated from the coil 6 and the operating characteristic be deteriorate due to the rise in temperature in some cases. In this case, in the electromagnetic relay having the above-described configuration, the surface area of the movable contact piece 33 is increased to the extent that approximates almost the maximum area at two places of the attaching portion of the movable iron piece 8 and the attaching portion of the yoke 7. For this reason, the heat generated from the coil 6 is transferred through the movable iron piece 8 and the yoke 7 so that it is sufficiently dissipated from the movable contact piece 33. Therefore, the electromagnet blocks 1 are not overheated and deteriorated in the operating characteristic.

The present invention is not limited to the configuration described in the preferred embodiment and can be modified in various ways.

For example, although two electromagnet blocks 1 are provided side by side in the above-described embodiment, three or more electromagnet blocks may be also provided. In this case, the first fixed terminal 34 and the second fixed terminal 35 may be further extended, and the contact stands and the press-fitted portions are increased in number so as to correspond to the increased number of the electromagnet blocks 1.

There has thus been shown and described an electromagnetic relay using the same which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An electromagnetic relay comprising:

a plurality of electromagnet blocks, each block including an electromagnet configured by winding a coil around an iron core via a spool, a yoke having a to-be-connected portion which is to be connected to a connection portion of one end of the iron core and a rising portion extending laterally from a magnetic pole portion of the iron core, a movable iron piece turnably supported by a distal end of the rising portion of the yoke and attracted to the magnetic pole portion of the iron core by magnetization of the electromagnet; and a contact switching mechanism including a movable contact piece attached to the movable iron piece and provided with a movable contact, and a fixed terminal attached to the spool to integrally combine the plurality of electromagnet blocks and provided with a fixed contact arranged to be brought into contact with and move away from the movable contact, wherein the movable contact piece includes a contact attaching portion to which the movable contact is attached and a horizontal fixed portion that is attached to the movable iron piece, wherein a first connection portion extends upward by a thickness of the movable iron piece and connects at one side of the horizontal fixed portion and a second connection portion, which is bent at a right angle along the movable iron piece and the yoke, connects to a second side of the horizontal fixed portion, wherein the horizontal fixed portion is brought into surface contact with the movable iron piece and wherein a width of a surface contact of the horizontal fixed portion is substantially equal to an entire width of the movable iron piece;

wherein the width of the surface contact of the horizontal fixed portion is larger than a width of the contact attaching portion.

2. The electromagnetic relay according to claim 1, wherein each of the spools is provided with flanges that are arranged side by side near the other end of the iron core at which the magnetic pole portion is arranged, each of the flange portions has a press-fitting recess at one side thereof in a direction of parallel arrangement thereof, the fixed terminal includes a plurality of press-fitted portions to be press-fitted into the press-fitting recesses of the respective spools, and the plurality of press-fitted portions are formed by cutting and raising portions of the fixed terminal along the direction of parallel arrangement.

3. The electromagnetic relay according to claim 2, wherein the movable contact piece is made of an elastic material with a higher thermal conductivity than the movable iron piece and the yoke.

4. The electromagnetic relay according to claim 1, wherein the movable contact piece is made of an elastic material with a higher thermal conductivity than the movable iron piece and the yoke.

5. An electromagnetic relay comprising:

a plurality of electromagnet blocks, each block including an electromagnet configured by winding a coil around an iron core via a spool, a yoke having a to-be-connected portion which is to be connected to a connection portion of one end of the iron core and a rising portion extending laterally from a magnetic pole portion of the iron core, a movable iron piece turnably supported by a distal end of the rising portion of the yoke and attracted to the magnetic pole portion of the iron core by magnetization of the electromagnet; and a contact switching mechanism including a movable contact piece attached to the movable iron piece and provided with a movable contact, and a fixed terminal attached to the spool to integrally combine the plurality of electromagnet blocks and provided with a fixed contact arranged to be brought into contact with and move away from the movable contact, wherein the movable contact piece includes a contact attaching portion to which the movable contact is attached and a vertical fixed portion that is attached to the rising portion of the yoke, and the vertical fixed portion is brought into surface contact with the yoke and is substantially equal in width dimension to the yoke;

wherein the vertical fixed portion is connected to a connection portion which is bent at about a right angle along the movable iron piece and the yoke;

a width of the vertical fixed portion is larger than a width of the connection portion; and the width of the vertical fixed portion and a height of the vertical fixed portion extend so as to maximize the surface area contact between the vertical fixed portion and the rising portion of the yoke.

6. The electromagnetic relay according to claim 5, wherein each of the spools is provided with flanges that are arranged side by side near the other end of the iron core at which the magnetic pole portion is arranged, each of the flange portions has a press-fitting recess at one side thereof in a direction of parallel arrangement thereof, the fixed terminal includes a plurality of press-fitted portions to be press-fitted into the press-fitting recesses of the respective spools, and the plurality of press-fitted portions are formed by cutting and raising portions of the fixed terminal along the direction of parallel arrangement.

7. The electromagnetic relay according to claim 6, wherein the movable contact piece is made of an elastic material with a higher thermal conductivity than the movable iron piece and the yoke.

8. The electromagnetic relay according to claim 5, wherein the movable contact piece is made of an elastic material with a higher thermal conductivity than the movable iron piece and the yoke.

* * * * *